US005535962A

United States Patent [19]

Bargowski

[11] Patent Number: 5,535,962

[45] Date of Patent: Jul. 16, 1996

[54] DOUBLING COUPLER FOR TOILET ROLL HOLDERS

[76] Inventor: Dennis P. Bargowski, 41621 Greenwood Dr., Canton, Mich. 48187

[21] Appl. No.: 510,392

[22] Filed: Aug. 2, 1995

[51] Int. Cl.[6] ..... B65H 75/00

[52] U.S. Cl. ..... 242/594.3; 403/300

[58] Field of Search ..... 242/594, 594.3, 242/598, 599, 599.2; D6/518, 520, 522, 523; 403/300, 305

[56] References Cited

U.S. PATENT DOCUMENTS 2,108,333 2/1938 Hardin et al. .
3,101,181 8/1963 Clelland .
3,398,908 8/1968 Thompson .
4,025,004 5/1977 Massey .
4,124,259 11/1978 Harris .
4,177,958 12/1979 Poole .
4,607,809 8/1986 Sineni .

*Primary Examiner*—John P. Darling
*Attorney, Agent, or Firm*—Don Moyer

[57] ABSTRACT

The new doubling coupler is a generally cylindrical sleeve which connects two standard, spring-action cores for standard, toilet tissue paper roll holders to form a double-length core which can be held between two standard, toilet roll holder mounting brackets, which have been relocated to accommodate the double length core, in order to hold a toiler roll in position for use and also hold a spare roll also in position for use. There is a buffer attached to the sleeve to prevent rotary motion of the roll in use from being coupled directly to the spare roll.

4 Claims, 1 Drawing Sheet

DOUBLING COUPLER FOR TOILET ROLL HOLDERS

BACKGROUND OF THE INVENTION

This invention relates to devices which hold a roll of toilet tissue paper in position for use and which also hold a spare roll of toilet tissue paper also in position for use.

Problems which can arise when a spare toilet roll is not readily available at the place of use are well known, and a number of devices have been proposed for making a spare toilet roll readily available at the place of use. Clelland's U.S. Pat. No. 3,101,181 proposes a device which stores several toilet rolls in a manner which automatically dispenses a spare roll when needed. This device is not adapted to general consumer use because of its cost and because of the space it requires. A device for general consumer use is proposed in Thompson's U.S. Pat. 3,398,908. This device has a central bracket which can be attached to a wall and has two arms extending to the right and left sides of the bracket to hold two toilet rolls. It is difficult to commercialize a device like this because an entire new product must be sold and it is hard to compete for shelf space in the relevant marketplaces which are crowded with low cost standard products.

Other devices, such as those proposed in Harris' U.S. Pat. No. 4,124,259, Poole's U.S. Pat. No. 4,177,958, and Sineni's U.S. Pat. No. 4,607,809, are also difficult to commercialize for general consumers because they require to much shelf space among the low cost standard products sold in the relevant marketplaces.

Thus, there is an opportunity for a product which is used to make a spare toilet roll readily available and which can compete for shelf space among low cost standard products because it needs very little shelf space and works with the low cost standard products now sold in the relevant marketplaces.

SUMMARY OF THE INVENTION

Objects of this invention include the following. Make a device which will make a spare toilet role readily available. Make a device which works with standard parts to form a toilet roll holder which can hold a spare toilet roll. Make a device which easily fits with standard products now sold in relevant marketplaces.

In Summary, one embodiment of this invention is a generally cylindrical sleeve which couples stubs of two standard toilet roll holder cores to form a double-length toilet roll holder core which can be mounted in standard toilet roll holder mounting brackets to hold a roll of toilet tissue paper in position for use and also hold a spare toilet roll also in position for use, the sleeve having a buffer portion which prevents rotary motion of the roll in use being directly coupled to the spare toilet roll.

Other equivalent embodiments will be comprehended in the detailed description of the drawings, which will make additional equivalent embodiments obvious to people skilled in the art

DRAWING FIGURES

DETAILED DESCRIPTION OF THE DRAWINGS

Figure 1:
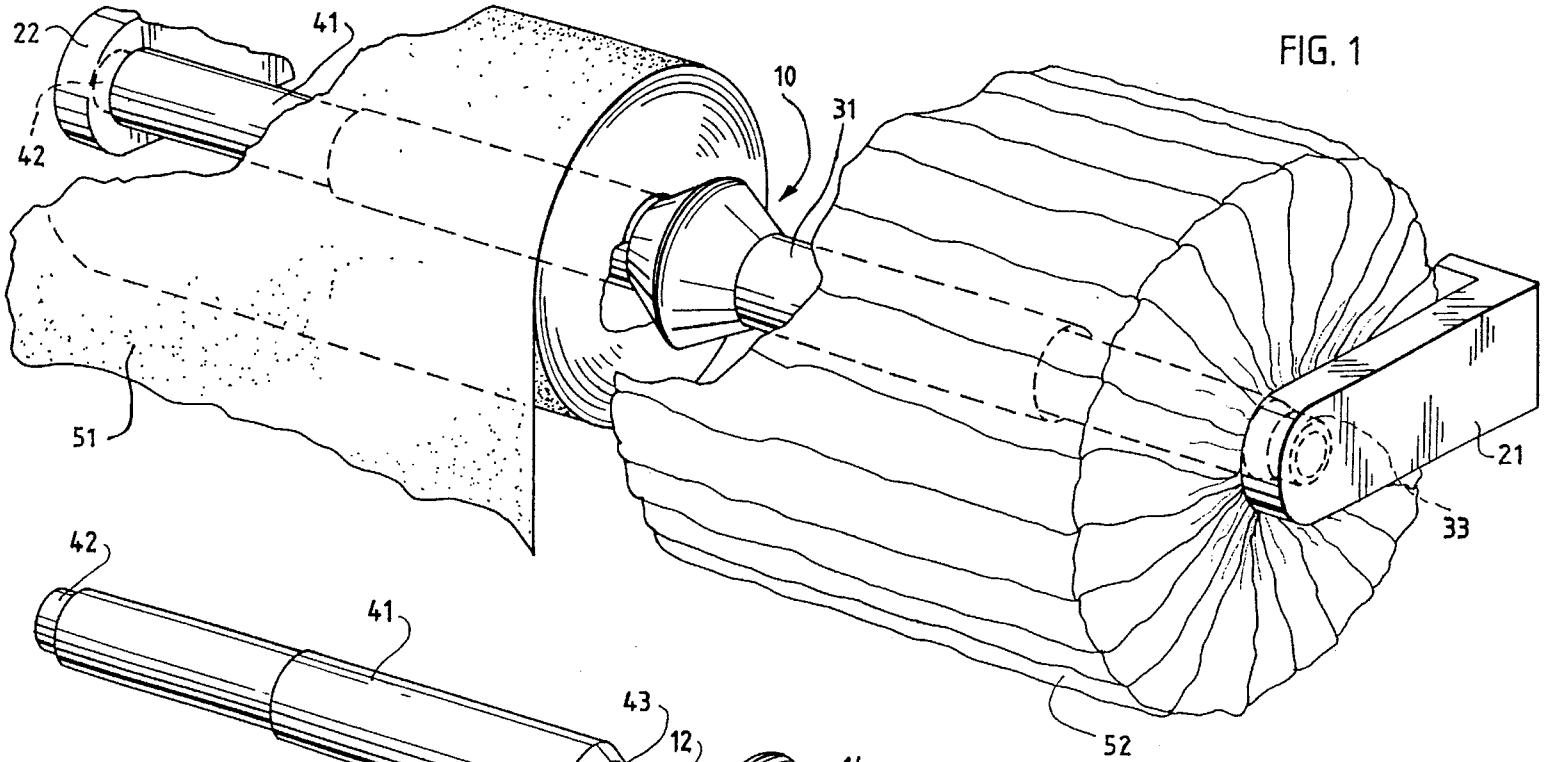
FIG. 1 shows the new doubling coupler in use.
Figure 2:
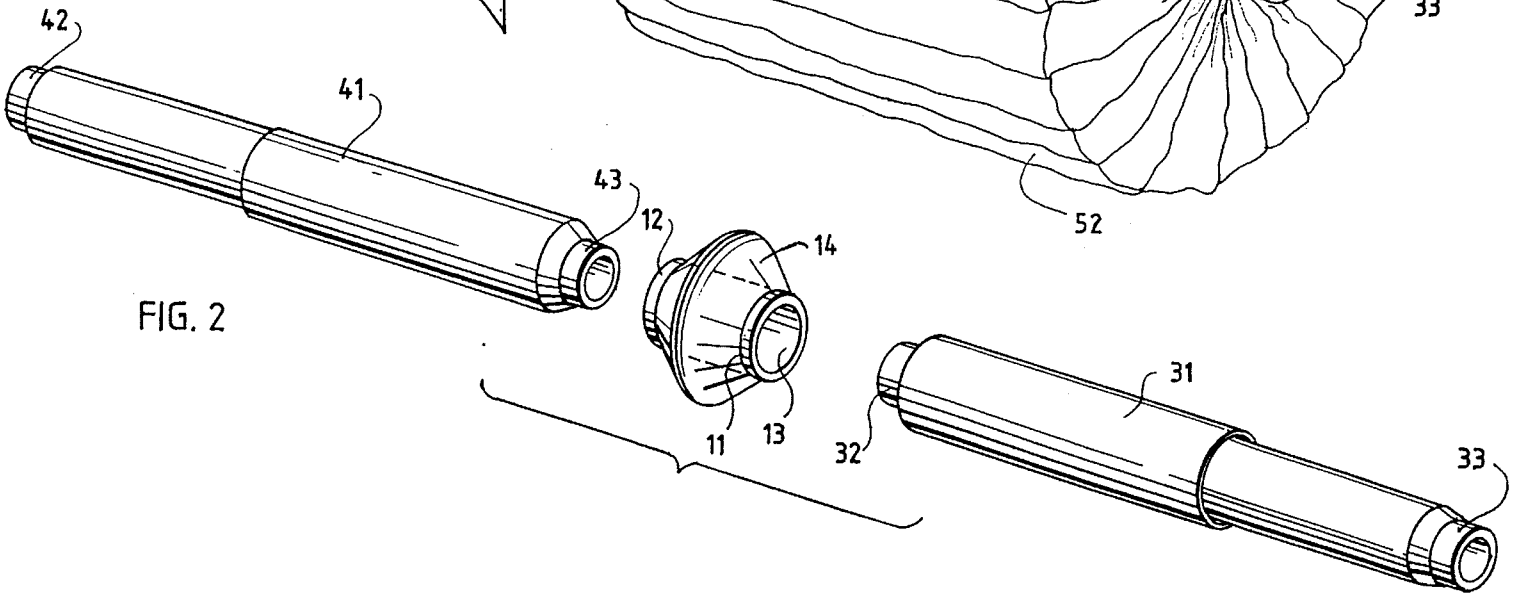
FIG. 2 is an exploded view which shows how the new doubling coupler relates to standard toilet roll holder cores.

In FIG. 1 the new doubling coupler 10 is shown in use coupling a first, standard, spring-action toilet roll holder core 31 to a second, standard, spring-action core 41 in order to hold a toilet roll 51 in position for use and also hold a spare roll 52 also in position for use. Details of the doubling coupler are best seen in FIG. 2. The doubling coupler is a generally cylindrical sleeve having a right sleeve end 11 and a left sleeve end 12. The doubling coupler is right-left symmetric so the ends can be exchanged. The sleeve has a generally cylindrical inner surface 13. A buffer 14, which is generally disc shaped and concentric with the sleeve and has a radius greater than the largest radius of the standard core, is attached to the coupler midway between the two ends 11 and 12.

The standard, spring-action toilet roll holder cores 31 and 41 are both generally cylindrical and are generally identical. Each terminates with a right stub 33 and 43 and with a left stub 32 and 42. For use, the cores 31 and 41 are right-left symmetric, so that the stubs 32 and 33 and stubs 42 and 43 can be exchanged. The left stub 32 of core 31 can be fastened into the coupler right sleeve end 11, and the right stub 43 of core 41 can be fastened into the coupler left sleeve end 12. The stubs 32, 33, 42, and 43, which are generally identical, are generally cylindrical with a radius just less than the radius of the coupler inner surface 13 so that the outer surfaces of the stubs 32 and 43 can be securely fastened to the coupler inner surface 13 using a standard adhesive or equivalent means.

Two standard cores 31 and 41 fastened to the doubling coupler as described form a single core with double the length of a standard core. A right, standard, toilet roll holder mounting bracket 21 and a left, standard, toilet roll holder mounting bracket 22 can be located so that the right stub 33 of the double-length core can be removably held in the right bracket 21 and the left stub 42 of the double-length core can be removably held in the left bracket 22 and so that a new doubled-length toilet roll holder can hold a roll 51 in position for use and also hold a spare roll 52 also in position for use as shown in FIG. 1. The the double-length core should be mounted so that sufficient tension will be provided by the spring action of the coupled cores to keep the double-length core from rotating in normal use so that rotary motion of the roll in use 51 is not transferred to the spare roll 52 by the double-length core. The buffer 14 keeps rotary motion of the role in use 51 from being transferred directly to the spare roll 52.

The preferred embodiment of the coupler fits a standard core with a standard five eighth inch outer diameter stub, such as the Futura replacement core, part number D 1400C, made by the Decor Bathware Division of the Franklin Brass Manufacturing Company of Los Angles Calif. Even standard toilet role holder cores which terminate with a series of stepped cylindrical stubs have a standard five eighth inch diameter stub which can be securely fastened to the coupler inner surface. These standard cores can be held by standard toilet roll holder mounting brackets, such as the Futura mounting brackets, part number D1408C, made by the Decor Bathware Division of the Franklin Brass Manufacturing Company of Los Angles Calif.

A double-length core made by integrally coupling a first core pollion and a second core portion with an integral buffer located at the mid-point of the double-length core would be an equivalent embodiment with respect to use. This equivalent double-length core would also be equivalent in appearance to the double-length core indicated in FIG. 1 and FIG.

2 except that the coupler portion 10 would be integral. The separate doubling coupler, which is distinct in manufacture and in commercial appeal, is preferred because it costs less, occupies less shelf space, and works with existing standard products. A person need only purchase the doubling coupler and purchase a standard, replacement core, then attach their existing, standard core and the new, standard, replacement core to the coupler, re-locate the existing, standard mounting brackets, and engage the double-length core in the mounting brackets with a roll in position for use and also a spare roll also in position for use.

Other equivalent forms for the coupler and other equivalent means for attaching standard parts will be obvious to people skilled in the art. It is understood therefore that this invention is not limited to the particular examples illustrated here.

I claim:

1. A doubling coupler comprising a generally cylindrical sleeve, the sleeve having a right sleeve end and a left sleeve end, such that a first, standard, spring-action toilet roll holder core can be fastened to the right sleeve end and such that a second, standard, spring-action toilet roll holder core can be fastened to the left sleeve end, so that when the first core is fastened to the right sleeve end and the second core is fastened to the left sleeve end a double-length core is formed which can be removably attached between a right, standard, toilet roll holder mounting bracket and a left, standard, toilet roll holder mounting bracket for holding a toilet roll in use and also holding a spare toilet roll in position for use.

2. The doubling coupler of claim 1 wherein the sleeve has a buffer attached to the sleeve midway between the right sleeve end and the left sleeve end for preventing rotary motion of the toilet roll in use from being directly coupled to the spare toilet roll.

3. A doubling coupler comprising a first core portion integrally connected to a second core portion to form a double-length toilet roll holder core which can be removably attached between a right, standard, toilet roll holder mounting bracket and a left, standard, toilet roll holder mounting bracket for holding a toilet roll in use and also holding a spare toilet roll also in position for use.

4. The doubling coupler of claim 3 wherein the double-length core has an integral buffer located generally at the mid-point of the double-length core for preventing rotary motion of the toilet roll in use from being directly coupled to the spare toilet roll.

* * * * *